United States Patent [19]

Friedenberg

[11] 4,182,084

[45] Jan. 8, 1980

[54] BLADE SHARPENER

[76] Inventor: Richard C. Friedenberg, P.O. Box 53, Spring Valley, N.Y. 10977

[21] Appl. No.: 902,065

[22] Filed: May 2, 1978

[51] Int. Cl.[2] ..... B24D 15/06

[52] U.S. Cl. ..... 51/214; 51/156; 51/161; 30/90

[58] Field of Search ..... 30/35, 37, 90, 138; 51/125, 156, 161, 211, H, 211 R, 214, 241 R, 241 G, 241 US, 250; 76/85

[56] References Cited

U.S. PATENT DOCUMENTS 3,163,964 1/1965 Wheeler ..... 30/37 X 3,163,965 1/1965 Wheeler ..... 51/156

3,935,638 2/1976 Rookus ..... 30/90

FOREIGN PATENT DOCUMENTS 1001150 1/1957 Fed. Rep. of Germany ..... 51/211 R

*Primary Examiner*—Gary L. Smith

*Attorney, Agent, or Firm*—Posnack, Roberts, Cohen & Spiecens

[57] ABSTRACT

A multi-part assembly of a honing disc base and a blade carrying cover to permit rotational contact of blade edges and honing surface for correct angle sharpening of the blade cutting edge of rotary type shavers.

2 Claims, 5 Drawing Figures

BLADE SHARPENER

BACKGROUND OF THE INVENTION

FIELD OF THE INVENTION

This invention relates to the sharpening of blades and more particularly to sharpeners for electric razor blades.

As with almost any type of cutting surface, the life and utility of a rotary blade is enhanced if it can be occasionally resharpened. Various types of rotary blades are known including, for example, rotary shaving blades, such as those incorporated in a NORELCO electric razor.

Prior attempts have been made to provide for sharpening such blades. Some such attempts are seen in the patents to one Raymond R. Wheeler (U.S. Pat. Nos. 2,953,851; 3,163,964 and 3,163,965 in particular). In these prior art teachings, it is proposed to bring a blade and honing disc into contact and thereafter rotate the blade or the disc to sharpen the blade cutting edge.

The first and last of the above-mentioned patents are particularly representative of prior efforts that illustrate the need for the improvements to be disclosed herein. In U.S. Pat. No. 2,953,851, a cup containing a honing ring is brought to the blade within the razor housing. In U.S. Pat. No. 3,163,965, a cup is carried by a cup that telescopes over the cup to guide and center the blade and honing ring. In this unit the cap is to be received within the razor's head.

In all these prior art structures, the only way to prevent blade damage during sharpening is to be extremely careful to watch the pressure used to bring blade and honing disc into contact. This means that it is difficult to obtain a correct angle of address of the blade and honing disc as any degree of pressure other than the correct amount can deform the spokes carrying the cutting surfaces.

SUMMARY OF THE INVENTION

It is an object of the invention to provide for automatic control of the above indicated uncontrollable pressures to improved blade sharpener.

In accordance with the invention there is provided a sharpener for an electric razor. This electric razor may include a body, a driven shaft extending therefrom and a rotary blade assembly adapted for being driven by said shaft. The shaft may include a main portion and an end portion on the main portion and defining a shoulder therewith. The rotary blade assembly will include a central disc, spokes extending from the disc and blades on said spokes and extending a common distance from the disc. The end portion extends through the disc with the disc against said shoulder to an extent less than the aforesaid common distance.

In further accordance with the invention, the sharpener comprises a base and a cover, said base fitting telescopically into said cover. Said cover will include a collar adapted to abut against the body of said razor and to guide the shaft into said cover. The base will include a cylindrical sidewall adapted for being received into said cover and an end face closing the sidewall and one end thereof and a projection on said end face and adapted for engaging against the end portion of the shaft.

In further accordance with the invention said sharpener comprises a honing means on said end face and the engagement of the projection against the end portion of the shaft limits the force with which the honing means engages the blades. Thereby, protection is afforded to the blades and distortion of the spokes and disc portion is prevented thereby assuring an optimized sharpening procedure.

According to a further aspect of the invention the aforesaid honing means may be a disc encircling the afore-mentioned projection.

DETAILED DESCRIPTION OF THE PREFERRED EMBODIMENT

Figure 1:
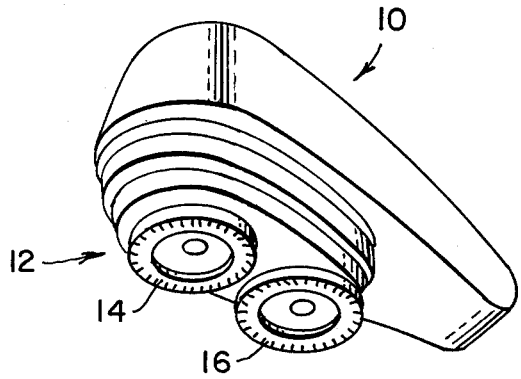
FIG. 1 is a known isometric view of an electric razor having two shaving heads using rotary blades of the type with which this invention is concerned.
Figure 2:
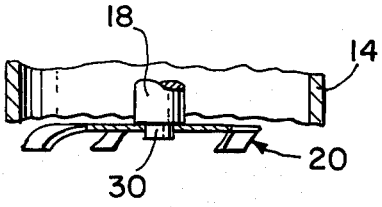
FIG. 2 is a fragmentary cross-section of one of the shaving head areas of FIG. 1 to show the disposition therein of a rotary blade.
Figure 3:
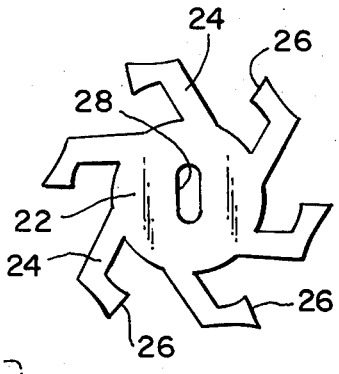
FIG. 3 is a plan view of the rotary blade of FIG. 2.

With more specific reference to FIG. 1, it is there shown that an electric razor 10 with which this invention is concerned has a shaving head 12 comprised of two slotted shaving faces 14 and 16. These faces are normally resilient to adjust to surface contours. They are designed so as to permit a drive shaft 18 (see FIG. 2) to rotate a blade means 20 therewithin. More particularly, and with reference to FIG. 3, the blade has a disc (hub) 22 with a plurality of spokes 24 carrying blade cutting edges 26 which in the assembled shaver are located closely adjacent the inside of the slotted faces 14 and 16. The disc (hub) 22 is provided with an elongated opening 28 to receive end 30 (See FIG. 2) of the drive shaft. Any number of arrangements may be used to prevent the disc or hub 22 from falling off end 30. The simplest such arrangement may be a conventional spring pin.

Figure 4:
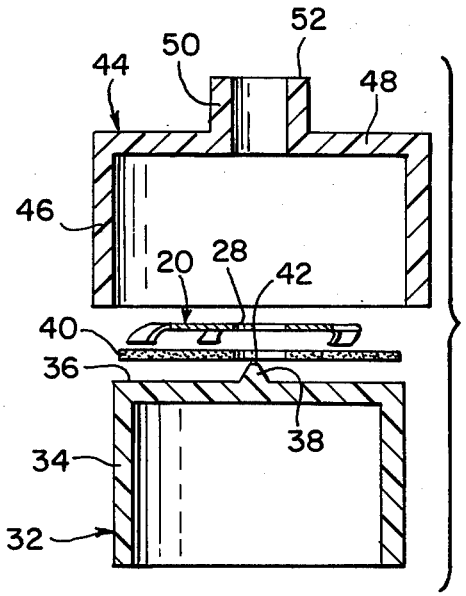
FIG. 4 is an exploded cross-sectional view of the sharpener of this invention as applicable to known blade of FIG. 3.

For discussion of the sharpener of this invention for use with such blades, attention is directed to FIG. 4. Therein, a base 32 is shown to be formed as a cylindrical member 34 having a face 36 closing one end of the cylinder and having a shaped hub or protrusion 38 projecting upwardly. A honing disc 40 of a commonly used abrasive material known in the art is removably affixed to the face 36 about the hub with the tip 42 above it. Any one of a number of bonding agents that can be released can be used to affix the disc 40 to face 36 as will be well known in the art.

Figure 5:
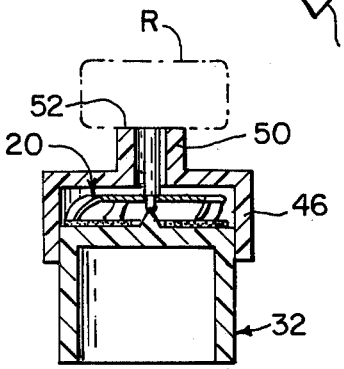
FIG. 5 is a section in elevation showing the apparatus of FIG. 4 with the blade in the process of being sharpened.

Referring now to FIG. 5, there is shown a collar 50 with a top face 52. The shaver body R seats against the top face. This arrangement prevents excessive pressure from being applied to the shaver blade. Excessive pressure could have undesired effects. For example, excessive pressure could result in binding thereby preventing rotation of the blade or even in excessive abrasion of the blades.

The remaining part of the sharpener of this invention is the cover 44 with its annular walls 46 and top 48 cooperatively formed as a cup that is designed to fig snugly over the base and telescope thereonto. A guide collar 50 is formed on cap 48 to be in registry with the hub 38 when assembled to the base. This collar will also be in alignment with opening 28 of blade 20 interposed during such assembly of cover 44 on base 32.

It will be understood that the drive shaft 18 is guided into the sharpener by collar 50 and that the tip 42 will engage the end 30 of shaft 18 to limit penetration of base 32 into cover 44. This will automatically prevent the generation of forces which might deform the blade means and will insure proper honing.

While there have been shown and described and pointed out the fundamental novel features of the invention as applied to a preferred embodiment thereof, it will be understood that various omissions, substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A sharpener for an electric razor, said electric razor including a body, a driven shaft extending therefrom, and a rotary blade assembly adapted for being driven by said shaft, said shaft including a main portion and an end portion on the main portion and defining a shoulder therewith, said rotary blade assembly including a central disc, spokes extending from said disc and blades on said spokes and extending a common distance from said disc, said end portion extending through said disc, with the disc against said shoulder, to an extent less than said common distance, said sharpener comprising a base and a cover, said base fitting telescopically into said cover, said cover including a collar adapted to abut against the body of said razor and to guide the shaft into said cover, said base including a cylindrical side wall adapted for being received into said cover and an end face closing the side wall at one end thereof and a projection on said end face and adapted for engaging against the end portion of said shaft, said sharpener further comprising a honing means on said end face, said projection extending from said end face to a level above said honing means and constituting a means for limiting the force with which the honing means engages said blades by engagement of said projection against the end portion of the shaft.

2. A sharpener as claimed in claim 1 wherein said honing means is a disc encircling said projection.

* * * * *